US006719638B2

(12) United States Patent
Wethered

(10) Patent No.: US 6,719,638 B2
(45) **Date of Patent: *Apr. 13, 2004**

(54) REPLACEABLE CUE TIP SYSTEM

(75) Inventor: William Wethered, Maple Valley, WA (US)

(73) Assignees: Pamela Gene Wethered-McClung, Maple Valley, WA (US); David William McClung, Maple Valley, WA (US)

( * ) Notice: Subject to any disclaimer, the term of this patent is extended or adjusted under 35 U.S.C. 154(b) by 98 days.

This patent is subject to a terminal disclaimer.

(21) Appl. No.: 09/778,256

(22) Filed: Feb. 6, 2001

(65) Prior Publication Data

US 2001/0051546 A1 Dec. 13, 2001

Related U.S. Application Data

(63) Continuation-in-part of application No. 08/882,483, filed on Jun. 25, 1997, now Pat. No. 6,183,371.
(60) Provisional application No. 60/022,012, filed on Jun. 25, 1996.

(51) Int. Cl.[7] ..... A63D 15/08
(52) U.S. Cl. ..... 473/49
(58) Field of Search ..... 473/44–49

(56) References Cited

U.S. PATENT DOCUMENTS

| | | | | |
|---|---|---|---|---|
| 338,888 A | | 3/1886 | Tracy | |
| 583,009 A | | 5/1897 | Cunningham | |
| 860,381 A | | 7/1907 | Holden | |
| 934,162 A | | 9/1909 | Gormon | |
| 1,077,664 A | | 11/1913 | Ankenmann | |
| 1,141,587 A | | 6/1915 | Smith | |
| 1,476,622 A | | 12/1923 | Kirk | |
| 1,544,696 A | | 7/1925 | Sprenkel | |
| 1,614,414 A | | 2/1927 | Vargo | |
| 2,544,970 A | | 3/1951 | Watson | 273/70 |
| 3,226,119 A | | 12/1965 | Foy | 273/70 |
| 6,183,371 B1 | * | 2/2001 | Wethered | 473/44 |

FOREIGN PATENT DOCUMENTS

| | | |
|---|---|---|
| DE | 20222 | 5/1905 |
| FR | 573159 | 6/1924 |
| FR | 785.662 | 8/1935 |
| GB | 150651 | 9/1920 |

* cited by examiner

*Primary Examiner*—Mark S. Graham
(74) *Attorney, Agent, or Firm*—R. Reams Goodloe, Jr.

(57) ABSTRACT

A cue tip mounting system. A system for releasably securing a leather cue tip to a cue stick is provided. The system provides a tip mount for permanent mounting in the distal end of a cue stick. The tip mount has a threaded shaft extending outward along central axis for releasable threaded engagement with interior threads provided in a detachable mounting ferrule. The mounting ferrule has, at the tip end thereof, a centrally located nipple with flat distal surface for providing a centering force on a leather tip which is adhesively bonded to the tip end of the mounting ferrule. The tip is provided with a nipple accepting cup adapted to receiving the centering nipple protruding from the in the mounting ferrule. Preferably, the tip mount is provided in brass, and the ferrule in brass or aluminum, for absorbing shock.

4 Claims, 7 Drawing Sheets

PRIOR ART

REPLACEABLE CUE TIP SYSTEM

This application is a Continuation-in-Part of application Ser. No. 08/882,483, filed on Jun. 25, 1997, U.S. Pat. No. 6,183,371 which claims the benefit of U.S. Provisional Patent Application Serial No. 60/022,012 filed on Jun. 25, 1996.

FIELD OF THE INVENTION

My invention relates to a system for reliably mounting cue tips, and more particularly, to a unique, particularized, cooperative design configuration which provides reliable, yet replaceable cue tips for pool or billiard cue sticks.

BACKGROUND

Users of cue sticks have for years been faced with the problem of how to simply yet reliably replace the tip of the cue when it begins to wear to an undesirable extent. Over the years, as reproducible machine parts and advanced adhesives have become available, various cue replacement systems have been devised which enable the user to maintain use of a favorite cue stick by having a worn out cue tip replaced. Some of the systems known to me have been susceptible to undesirable problems, including inadequate strength in various joints. Often, in current designs, there is a tendency to split the cue stick when the stick is used for a shot where high compressive forces are applied to the tip and cue, such as during a break shot. Other systems are sufficiently complicated that it is difficult to provide the parts inexpensively enough to interest large segments of the market for such devices. As a consequence, there is still an unmet need for improvements to systems and apparatus that have been used heretofore for replacement of cue tips.

SUMMARY OF THE INVENTION

I have now invented, and disclose herein, a novel system and apparatus configuration for attachment of cue tips to cue sticks. The system is especially adapted for the replaceable attachment of a cue tip to a cue stick of preselected length. In one embodiment, a permanent tip mount is first affixed to the distal end of the cue stick. The tip mount has a cue side and a ferrule side, and includes a generally central disk portion having an annular annular shaped edge portion which forms a cap ring along the periphery of the cue side. The tip mount is provided with a central mounting shaft extending from the center of the tip mount in the cue side direction for a length $L_{66}$, adapted for tight fitting engagement in a centered borehole in the cue shaft. On the tip side of the tip mount, a ferrule attachment shaft is provided. The ferrule attachment shaft extends from the flat front impact absorbing side of the tip mount along a central axis in the tip direction for a length $L_{90}$. The ferrule attachment shaft is threaded for receiving a ferrule. A removable, replaceable ferrule itself has a cue end and a tip end. On the cue end of the ferrule, a centrally located internal thread is provided for threaded engagement with the ferrule attachment shaft. Thus, a removable, replaceable ferrule is configured for secure but releasable attachment to the ferrule attachment shaft of the tip mount. A leather cue tip is adhesively bonded to the tip side of the removable ferrule. Ideally, the tip side of the ferrule also include an annular securing ring which is spaced inwardly from the peripheral surface of the ferrule, and protrudes outwardly from the tip end, to define a tip receiving shoulder along the radially distal reaches of the tip end of the ferrule. A tip is provided having a recessed annular shaped ferrule receiving portion complementary in size and shape for accommodating in tight fitting engagement the annular securing ring of the ferrule. In this manner, the annular shaped ferrule receiving portion further defines (a) a centrally located nipple portion protruding in the cue direction from the ferrule end of the tip, and (b) an annular shaped peripheral tip ring portion which is located at the outer periphery of the tip. The peripheral tip ring is sized and shaped for close fitting engagement with the tip receiving shoulder on the cue end of the ferrule. Preferably, the tip is adhesively bonded to the ferrule. Also, the nipple in the tip includes a flat central land to provide a stable centering force to the cue tip upon impact with a ball.

OBJECTS, ADVANTAGES, AND NOVEL FEATURES

I have now invented, and disclose herein, a novel system for providing replaceable cue tips. My system does not have the drawbacks common to those somewhat similar products heretofore used of which I am aware. Unlike the earlier designs, the components of my system are simple, lightweight, relatively inexpensive and easy to manufacture, and otherwise superior to those designs heretofore used or proposed. In addition, my system provides a significant, additional measure of ease in repeatedly replacing a cue tip.

From the foregoing, it will be apparent to the reader that one important and primary object of the present invention resides in the provision of a novel system for replacement of cue tips.

Other important but more specific objects of the invention reside in the provision of a simple cue tip replacement system as described herein which:

- provides a strong cue tip which is highly resistant to shear;
- provides apparatus for joining a tip to a cue stick in a manner which does not transmit compressive strain to the cue stick in a fashion which tends to deform or split the cue stick;
- can be manufactured in a simple, straightforward manner of strong, resilient, breakage resistant materials; and
- in conjunction with the preceding object, have the advantage that they can be quickly and easily serviced to provide a reliable, replaceable cue tip.

Other important objects, features, and additional advantages of my invention will become apparent to the reader from the foregoing and as the ensuing detailed description and discussion proceeds in conjunction with the accompanying drawing.

Figure 1:
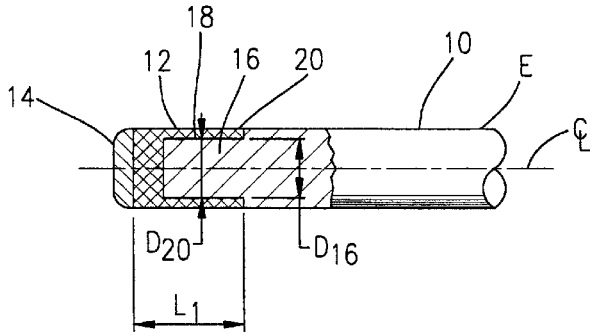
FIG. 1 is a cross sectional view of a prior art cue tip attachment system.

In the various figures, like parts will be shown via use of identical numbers, without further mention thereof. Also, at various places in the description, certain diameters are mentioned at locations which are implicitly referenced along a centerline of the drawing, and without otherwise identifying the location on the drawings, and it is to be understood that such diameters are with respect to diameters perpendicular to the centerlines shown in the various drawings and at the referenced line, unless otherwise shown or indicated.

DESCRIPTION

Attention is directed to FIG. 1 of the drawing wherein a prior art cue stick 10 is shown finished with a replaceable ferrule 12 attached thereto, and to which a leather tip 14 is adhesively joined. Such systems require use of a lathe to form a cylindrical tenon 16 in cue stick 10. On tenon 16, a cylindrical face surface 18 of outside diameter $D_{16}$ is provided complementary in size to the inside diameter $D_{20}$ of cap portion 20 of ferrule 12. Importantly, since the ferrule 12 is glued to tenon 16, each time a tip 14 is replaced, the cue stick 10 is shortened by a length $L_1$ sufficient to enable formation of a new tenon 16' (like tenon 16, but not shown), for affixing a new ferrule 12' (like ferrule 12, but not shown) to cue stick 10. This system and the parts used as just described will result, over time, in an unacceptable shortening of the cue stick 10.

Figure 2:
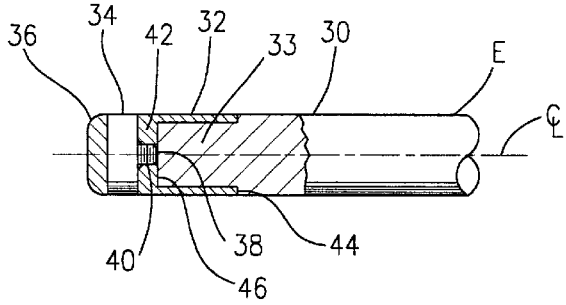
PRIOR ART FIG 2
FIG. 2 is a cross sectional view of a second prior art cue tip attachment system.

A similar, but somewhat improved prior art system is shown in FIG. 2, where an "Adams Import" brand type of cue replacement system is shown. In that system, a cue stick 30 is provided with a permanent, usually brass ferrule 32 attached to tenon 33 in the manner described above. A replaceable tip base 34 is provided, and the tip base 34 has adhesively attached thereto a leather tip 36. The tip base 34 has a screw fastener 38 which fits into screw receiving threads 40 in the end body 42 of permanent ferrule 32. This system avoids repeated shortening of cue stick 30 as new tips are provided, since only the tip base 34 and accompanying leather tip 36 are replaced.

Both of the above disclosed cue tip replacement systems have drawbacks. In the first system described, the cue stick 10 will inevitably be shortened over time, resulting in the need for increasingly larger diameter ferrules 12 to allow attachment to cue stick 10 at a smooth joint. Also, neither design provides a uniform compressive force to the cue sticks 10 or 30, and thus, in time, such sticks may tend to split to reflect the shearing motion between differing compressive forces imparted along the outer edge E and along the centerline $C_L$ of cue sticks 10 or 30, for example by peripheral end 44 and interior end 46 of permanent ferrule 32.

Figure 3:
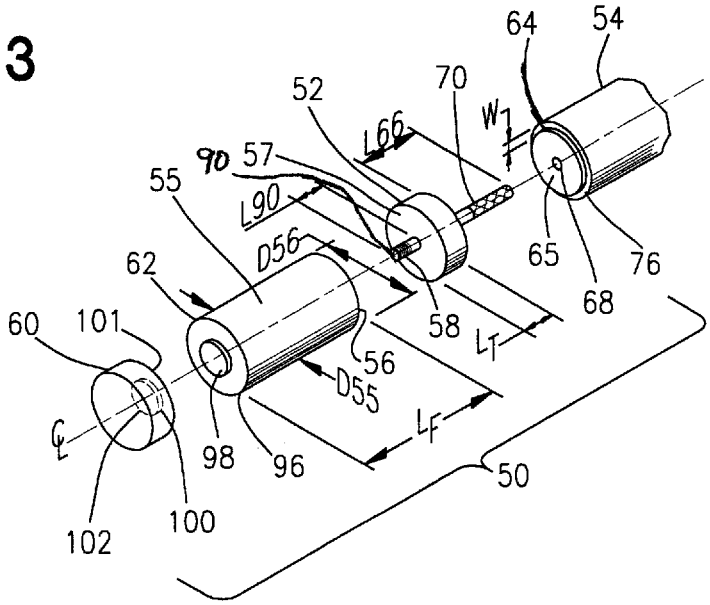
FIG. 3 is an exploded perspective view of one embodiment of my novel cue tip attachment system, showing a leather tip, a removable replaceable ferrule, a permanent tip mount, and the distal end of a cue stick.

Turning now to FIG. 3, my novel replaceable tip system components 50 are shown in an expanded perspective view. A tip mount 52 is provided for permanent attachment to the cue stick 54. A removable ferrule 55 having a cue or rear end 56 of diameter $D_{56}$ that is complementary in size and shape to the front 57 of tip mount 52 that has a diameter $D_{57}$. Tip mount 52 is provided with appropriate fastener, preferably threads 58 on shaft 90, for detachable fastening engagement with the ferrule 55. A tip 60, preferably high quality leather, is fixedly attached to the tip end 62 of ferrule 55, preferably by permanent bond using a high quality adhesive.

Figure 5:
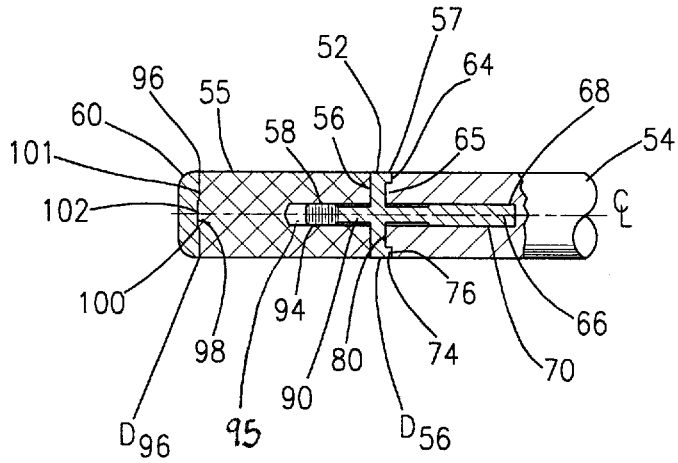
FIG. 5 is a cross sectional view of the fully assembled cue stick first shown in FIG. 3, shown with detachable tip, shown with the cue tip affixed using a detachable, replaceable ferrule.

Further specifics of each component of my replaceable cue tip system 50 are important because they provide a clear performance improvement over prior art cue tip fastening systems. The permanent tip mount 52 is ideally provided in a relatively soft, somewhat shock absorbing (compressive impact absorbing) metal, most preferably brass. Also, tip mount 52 is preferably provided in one piece, as is evident in cross-section as illustrated in FIG. 5, so that it provides sufficient stiffness against lateral movement of the components of the system 50, once the tip mount 52 is securely mounted in cue stick 54. Tip mount 52 is adhesively bonded to the distal edge end 64 and distal central end 65 of cue stick 54. The tip mount 52 has a mounting shaft 66 for tight fitting insertion into, and adhesive bonding within, the borehole 68 which is provided along the centerline $C_L$ of cue stick 54. To increase friction in borehole 68 and thus the security of the tip mount 52 when it is affixed in place, the outer surface 70 of mounting shaft 66 is roughened, preferably with a knurled type surface as illustrated. Ideally, tip mount 52 is fixed in place in borehole 68 of cue 54 with the assistance of a high strength glue, such as Devcon, manufactured by ITW Brands of Wooddale, Ill., and sold under Universal Product Number 0-7814320845-4. The combination of an epoxy glue and the knurled outer surface 70 results in a superbly strong bond of the tip mount 52 to cue stick 54.

Tip mount 52 is ideally provided with a central impact absorbing disk portion 72 that has a flat front face 57. The disk portion 72 is preferably provided with a generally C-shaped cross-section, wherein the tips of the C are formed, on the cue side, by an inwardly extending shaped edge portion 74 of radial width W and having a face 75 complementary to the side of distal edge end 64 of cue 54. This shaped edge portion 74 is ideally provided in the shape of an annulus with outer diameter $D_{74}$, which diameter is the same as diameter as the outer diameter $D_{76}$ of cue 54 at corner 76, which corner defines the start of distal edge end 64 in cue 54. Radially inward from the annular shaped edge portion 74 of tip mount 52 is a smooth, flat, force transferring portion 80, preferably oriented transverse to the center line of the cue 54, so that force may be transferred uniformly and directly along the center line $C_L$ of cue 54.

The distal edge end 64 of cue 54 is sized and shaped to receive face 75 of the annular shaped edge portion 74 of tip mount 52. Likewise, the distal central end 65 is sized and shaped to receive in snug interfitting engagement the force transferring portion 80 of tip mount 52. The ability of the tip mount 52 to uniformly and reliably transmit force to the cue 54 is an important improvement in the art.

The ferrule 55 is provided for attachment to tip mount 52 via shaft 90. Exterior threads 58 on shaft 90, complementary to interior threads 94 in borehole 95 along centerline of ferrule 55, matingly engage to removably and securely affix ferrule 55 to the tip mount 52. The ferrule 55 cue end diameter $D_{56}$ is the same as diameter $D_{57}$ of tip mount 52, so as to match the diameter of tip mount 52. However, the diameter $D_{55}$ of the ferrule 55 may vary along its length, generally, so that at the distal end 96 of ferrule 55, the actual diameter $D_{96}$ is sometimes less than $D_{56}$. In this embodiment (different than various other shapes illustrated below), the ferrule 55 has provided at its distal end 96 a centrally located nipple 98 that increases the centering force transmitted to the tip 60. A central peripheral edge 100 in the back 101 of tip 60 defines the radial reaches of a nipple receiving cup 102 in tip 60 that is adapted to receive in complementary mating engagement the nipple 98 of ferrule 55. The tip 60 is preferably affixed to an aluminum or brass ferrule 55 with a suitable high strength glue. One suitable two part epoxy formulation which provides excellent results is available from JB Weld, and sold under Universal Product Number 043425826558. This combination of structural design and bonding provides a highly shear resistant leather tip 60 that is securely mounted on a cue stick 54.

Figure 6:
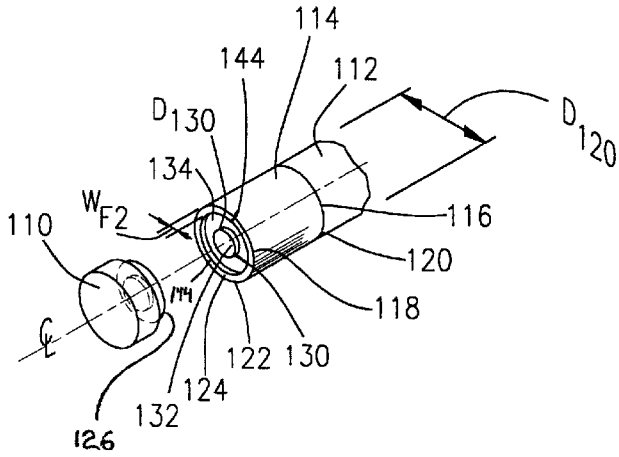
FIG. 6 shows a second embodiment of my ferrule and leather tip design where the ferrule is permanently mounted to the cue stick.
Figure 7:
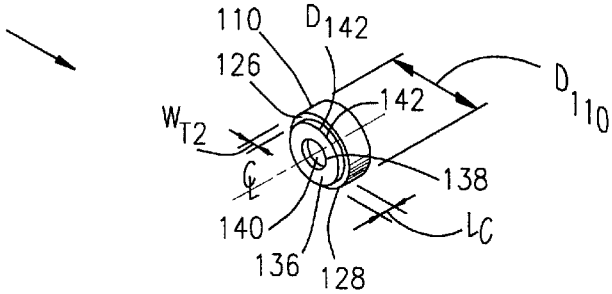
FIG. 7 provides in a back side view of the leather tip design first illustrated in FIG. 6, showing one embodiment of a cue tip having a large annular area provided for cushioning impact against a ball.
Figure 8:
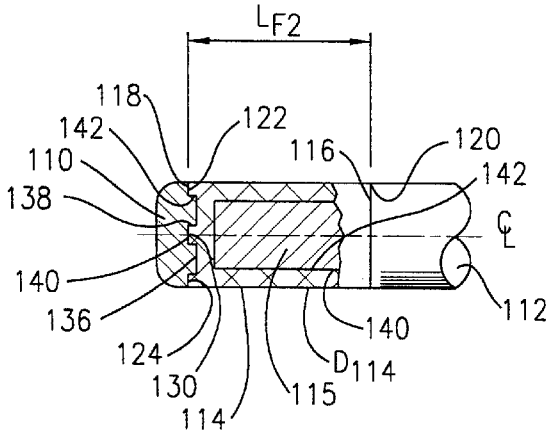
FIG. 8 illustrates, fully assembled, the embodiment of my ferrule and leather tip design as just illustrated in FIGS. 6 and 7 above.

Turning now to FIGS. 6, 7, and 8, another embodiment of my system is illustrated for affixing shaped tips 110 to cue sticks 112. A permanent mounting ferrule 114 is attached to cue stick 112 via high strength adhesive bond to a substantially cylindrical tenon 115. The ferrule 114 extends between a first, cue end 116 and a second, tip end 118, along a length $L_{F2}$. A corner 120 on cue 112 defines the outer peripheral end of cue 112, and at that point, the cue 112 has a diameter $D_{120}$. At the tip end 118, a thin outer annular cap ring 122 of width $W_{F2}$ is provided; in many applications, width $W_{F2}$ of about 1/16 inch is adequate. The thin annular cap ring 122 has a tip side face 124 sized to fit, in complementary fashion a receiving land 126 in the back 128 of tip 110. Along the centerline $C_L$ of the ferrule 114, a protruding nipple 130 of diameter $D_{130}$ with flat compression land 132 is provided, transverse to centerline $C_L$.

Between the cap ring 122 and the nipple 130, an annular shaped force transferring portion 134 is provided, preferably oriented transverse to the centerline $C_L$ of the cue 112. This force receiving portion 134 is sized complementary to the annular cushion portion 136 provided on the back 134 of tip 110. Also, note that the inner edge 138 of annular cushion portion 136 defines the edge of a nipple receiving cup 140 of diameter $D_{136}$ which is preferably complementary to diameter $D_{130}$ of nipple 130, so that the nipple 130 is securely and fully received in cup 140.

Outer edge 142 of annular cushion portion 136 defines a diameter $D_{142}$ that is complementary in size to inner edge 144 of the thin annular ring cap 122 in ferrule 114. The difference between diameter $D_{142}$ and the outer diameter $D_{110}$ of tip 110 defines the width $W_{T2}$ of receiving land 126. Length $L_c$ defines the thickness of annular cushion portion 136; approximately 1/16 inch is adequate length $L_c$ in most applications. The configuration just illustrated for the annular cap ring 122 and the annular cushion portion 136 is important since the annular ring cap 122 effectively captures the cushion portion 136, substantially preventing the tip 110 from spreading after repeated impacts. This construction is often of substantial benefit in preventing the tip 110 from shearing away.

For mounting, ferrule 114 is provided with outside diameter $D_{114}$ and with an inner surface 140 of inner diameter $D_{140}$. The ferrule 114 is tightly fitted over the circular cross section, and preferably cylindrical outer wall 142 of diameter $D_{142}$ of tenon 115. Also, it should be understood that this embodiment is equally suitable for retrofit of certain types of existing ferrules (as it is for mounting of new ferrules), by the machining of suitable existing ferrules to provide a new annular cap ring 122.

Figure 9:
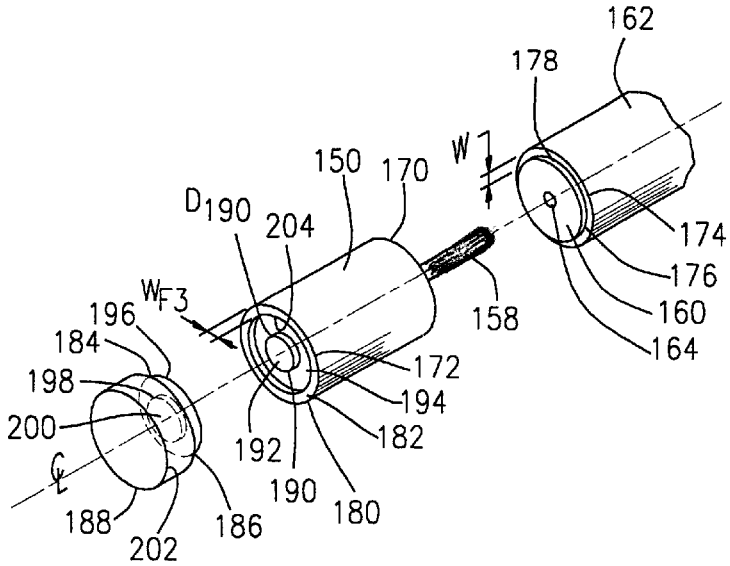
FIG. 9 illustrates still another embodiment of my tip attachment system, where the ferrule permanently mounts to the cue, and where a large annular area is provided on a leather tip for cushioning impact.
Figure 10:
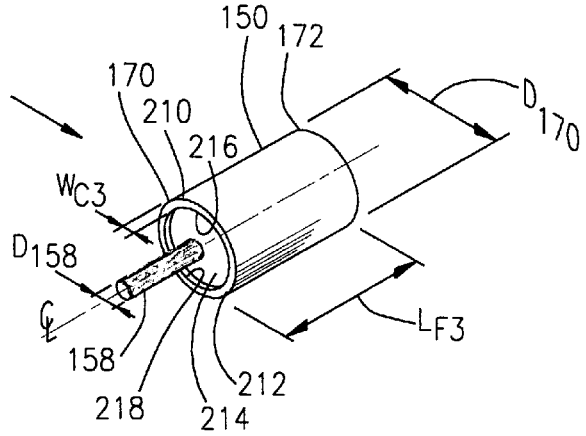
FIG. 10 is a back side perspective view showing details of the design of the permanently mounted ferrule just set forth in FIG. 9.
Figure 11:
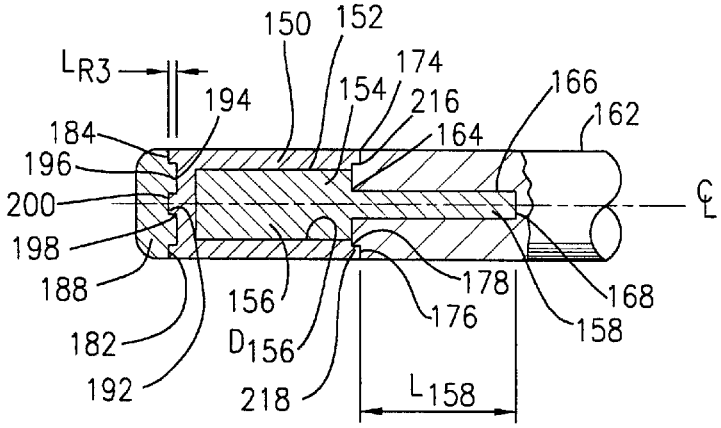
FIG. 11 illustrates the fully assembled components in one embodiment of my tip mounting system, namely a leather tip with large annular cushion area, and a permanently mounted ferrule, of the type just set forth in FIGS. 9 and 10 above.

Next, turning to FIGS. 9, 10, and 11, still another embodiment of my tip mounting system is provided. In this embodiment, my peripheral cap ring system is used in both the attachment of a permanent mounting ferrule 150 to a cue 162, and in the attachment of a leather tip 188 to the permanent mounting ferrule 150. This is important, since the advantages of the cap ring system work in both situations to enhance service life of the combination of cue 162, mounting ferrule 150, and tip 188.

In the embodiment shown in FIGS. 9, 10, and 11, ferrule 150 is provided with a central bore 152 of diameter $D_{152}$, into which is inserted a tight fitting wooden plug 154 that is preferably substantially cylindrical, and basically paddle shaped in cross-section. The plug 154 has a cue tip end (also called the bottom portion) 156 with outer diameter $D_{156}$. A preferably integrally provided mounting shaft 158 of length $L_{158}$ with outer diameter $D_{158}$ is provided. The distal central end 160 of cue 162 has drilled therein, and extending inwardly along the centerline thereof, a borehole defined by entry 164, interior edge 166, and interior end wall 168. The borehole is at least as long as, and preferably sized substantially complementary to, the length $L_{158}$ and diameter $D_{158}$ of mounting shaft 158. Mounting shaft 158 is ideally provided in a hardwood, such as "hardrock maple" grade wood. Ferrules such as ferrules 150 can be provided in any suitable material such as Formica brand, Aegis brand, Corian brand, Ivorine brand, or other resinous, hard plastic, or composite resin materials.

The ferrule 150 extends between a first, cue end 170 and a second, tip end 172, along a length $L_{F3}$. A corner 174 on cue 162 defines the outer peripheral end of cue 162, and at that point, the cue 112 has a diameter $D_{174}$. A land 176 extends radially inwardly from corner 174 to endwall 178.

At the tip end 172 of ferrule 150, a thin outer peripheral annular cap ring 180 of width $W_{F3}$ is provided. In many applications, width $W_{F3}$ of about 1/16 inch is adequate, and a corresponding depth $L_{R3}$ of about 1/16 inch is adequate. The thin peripheral cap ring 180 has a tip side face 182 sized to fit, in complementary fashion, a receiving land 184 in the back 186 of tip 188. Along the centerline $C_L$ of the ferrule 150, a protruding nipple 190 of diameter $D_{190}$ with flat compression land 192 is provided, transverse to centerline $C_L$.

Between the cap ring 180 and the nipple 190, an annular shaped impact absorbing, force-transferring portion 194 is provided, preferably flat and oriented transverse to the centerline $C_L$ of the cue 162. This force transferring portion 194 is sized complementary to the annular cushion portion 196 provided on the back 186 of tip 188. Also, note that the inner edge 198 of annular cushion portion 196 defines a nipple receiving cup 200 of diameter $D_{198}$ which is preferably complementary to diameter $D_{190}$ of nipple 190, so that the nipple 190 is securely and fully received in cup 200.

Outer edge 202 of annular cushion portion 196 defines a diameter $D_{202}$ that is complementary in size to inner edge 204 of the thin annular cap ring 180 in ferrule 150. The difference between outer diameter $D_{150}$ and the inner diameter $D_{204}$ of ring 180 defines the width $W_{F3}$ of face 182. Length $L_{R3}$ defines the depth of the force-transferring portion 194; approximately 1/16 inch is adequate length $L_{R3}$ in many applications. The configuration just illustrated for the annular peripheral ring cap 180 and the annular cushion portion 196 is important since the cap ring 180 effectively captures the annular cushion portion 196, substantially preventing the tip 188 from spreading after repeated impacts. This construction is of substantial benefit in preventing the tip 188 from shearing away.

In FIG. 10, the cue end 170 of permanent mounting ferrule 150 is depicted, and it can be appreciated that the annular ring cap type construction is also featured. Here, at the cue end 170 of ferrule 150, a thin outer peripheral annular cue end cap ring 210 of width $W_{C3}$ is provided. In many applications, width $W_{C3}$ of about 1/16 inch is adequate, and a corresponding depth $L_{R3}$ of about 1/16 inch is adequate. The thin peripheral cue end cap ring 210 has a tip side face 212 sized to fit, in complementary fashion, a receiving land 176 in cue 162. Along the centerline $C_L$ of the ferrule 150, the mounting shaft 158 protrudes toward the cue 162.

Between the cue end cap ring 210 and the mounting shaft 158, an annular shaped cue end force transferring portion 214 is provided, preferably flat and oriented transverse to the centerline $C_L$ of the cue 162. This force transferring portion 214 is sized complementary to the distal central end 160 of cue 162. Also, note that the inner edge 216 of the cue end annular cap ring 210 defines an inner surface 218 complementary to the mating surface 178 of cue 162. The configuration just illustrated for the cue end peripheral ring cap 210 and the distal central end 160 of cue 162 is important since the cue end cap ring 210 effectively captures most of the distal end of cue 162 inside of inner edge 216, thus substantially preventing the cue 162 from splitting after repeated impacts. Said another way, the cue end ring cap 210 effectively prevents the wood in the distal end of the cue 162 from spreading radially outward upon impact, thus preventing breakage of fiber and disbanding or splitting of the wood. Thus, this construction is of substantial benefit in preventing the cue 162 from splitting during repeated high compression usage.

Figure 4:
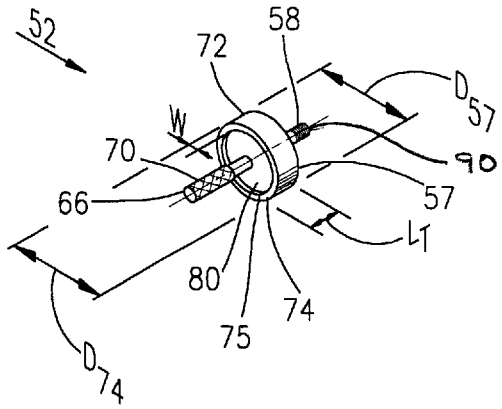
FIG. 4 is a perspective view of the back side of a tip mount which is permanently affixable to a cue stick and which is then used to join a mounting ferrule to the cue stick.
Figure 12:
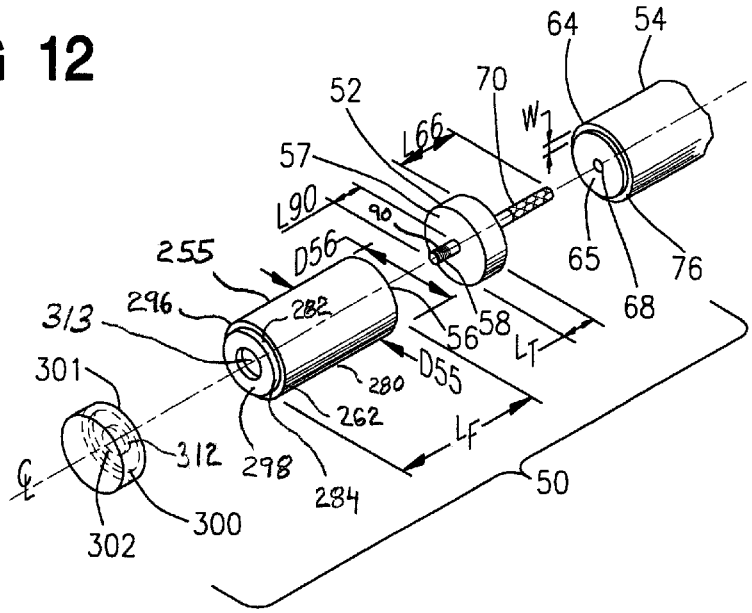
FIG. 12 illustrates yet a further embodiment of my cue tip attachment system, in an exploded perspective view similar to FIG. 3 above, now illustrating the alternate structure for mounting a leather tip to the removable ferrule, where an annular securing ring is provided in the ferrule for receiving the impact of forces from the cue tip, and wherein the leather tip has an annular shaped peripheral ring and a central nipple with a flat land, and where both the ring and the nipple are configured for close fitting engagement with the removable, replaceable ferrule.
Figure 13:
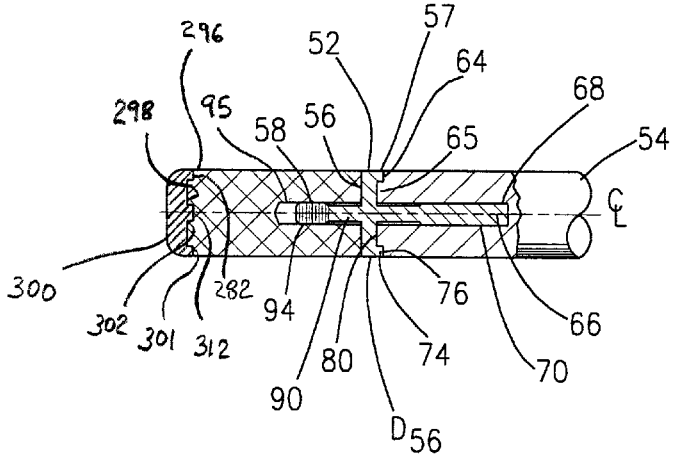
FIG. 13 is a cross sectional view of the fully assembled cue stick first shown in FIG. 2, shown with a permanent mount, a detachable replaceable ferrule, and leather tip with annular peripheral ring and central nipple with flat land for transmitting force to the replaceable ferrule.

Turning now to FIGS. 12 and 13, yet another embodiment 50' is shown for my novel replaceable tip system, similar to the embodiments first shown in FIGS. 3, 4 and 5 above. A tip mount 52 is provided for permanent attachment to the cue stick 54. A removable, replaceable ferrule 255 is provided having a cue or rear end 56 of diameter $D_{56}$ that is complementary in size and shape to the front 57 of tip mount 52. A tip 300, preferably of high quality leather, is fixedly attached to the tip end 262 of ferrule 255, preferably by permanent bond using a high quality adhesive.

Further specifics of the embodiment of the tip utilized in FIGS. 12 and 13, as well as FIGS. 14–19 below, are important because they provide a clear performance advantage in many applications, and thus represent an improvement in the art.

The ferrule 255 is provided for removable attachment to tip mount 52. Exterior threads 58 on shaft 90, complementary to interior threads 94 in borehole 95 along centerline of ferrule 255, matingly engage to removably and securely affix ferrule 255 to the tip mount 52. The ferrule 255 cue end diameter $D_{56}$ is the same as diameter $D_{57}$ of tip mount 52. However, the diameter $D_{255}$ of the ferrule 255 may vary along its length, generally, so that at the tip end 296 of ferrule 255, the actual diameter $D_{296}$ is sometimes less than $D_{56}$. In this embodiment (different than various other shapes illustrated above), the ferrule 255 has provided at its tip end 296 an annular securing ring 298 spaced inwardly from the peripheral surface 280 of ferrule 255 and protruding outwardly at the tip end 296, to define a tip receiving shoulder 282 along the radially distal reaches of the radially outward surface 284 of annular securing ring 298.

A tip 300 is provided having a centrally located nipple 302 with a preferably flat land 312 that increases the centering force transmitted to the central impact land 313 in mounting ferrule 255. An annular shaped peripheral edge portion 301 defines the radial reaches of the tip 300. The edge portion 301 is adapted to be received in complementary mating engagement by the shoulder 282 in the ferrule 255. The tip 300 is preferably affixed to an ferrule 255 with a suitable high strength glue. In FIG. 13, this embodiment is shown fully assembled.

Figure 14:
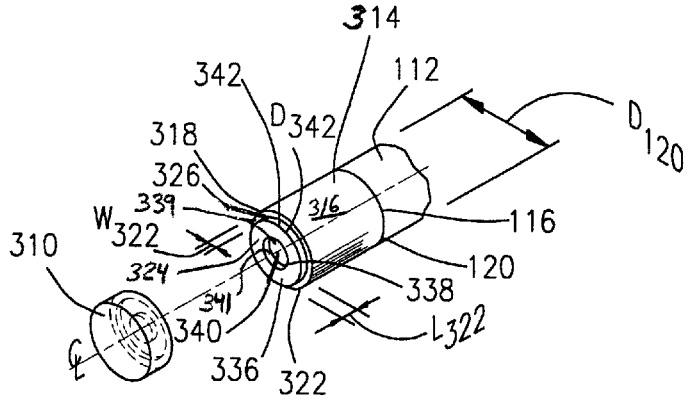
FIG. 14 illustrates yet another embodiment of my cue tip attachment system, where the ferrule is permanently mounted to the cue stick, but where the leather tip design is similar to that just illustrated in FIGS. 12 and 13, rather than the design shown in earlier figures.
Figure 15:
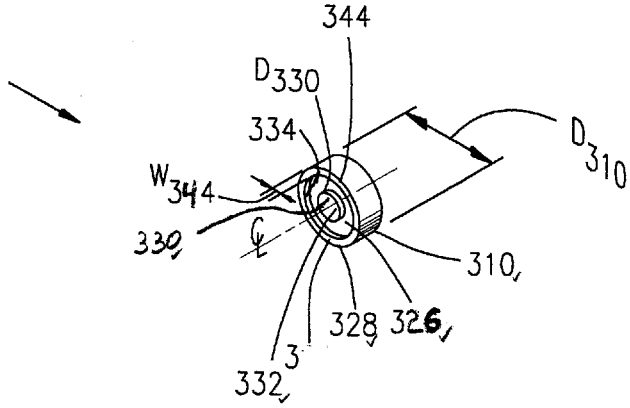
FIG. 15 provides in a back side view of the leather tip design first illustrated in FIGS. 12 and 13, showing a cue tip having a peripheral annular ring and a centrally located nipple with flat force transmitting land, and a large annular area provided for securing therein the annular securing ring of the permanent ferrule mount.
Figure 16:
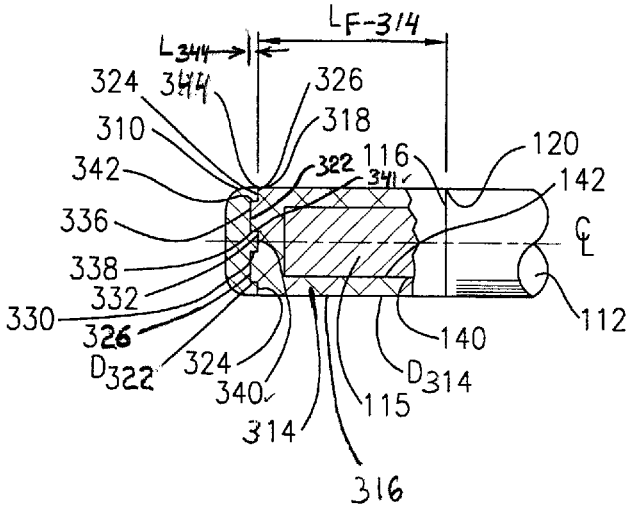
FIG. 16 illustrates, fully assembled, the embodiment of my ferrule and leather tip design as just illustrated in FIGS. 14 and 15 above.

Turning now to FIGS. 14, 15, and 16, another embodiment of my system is illustrated for affixing shaped tips 310 to cue sticks 112. A permanent mounting ferrule 314 is attached to cue stick 112 via high strength adhesive bond to a substantially cylindrical tenon 115. The ferrule 314 extends between a first, cue end 116 and a second, tip end 318, along a length $L_{F314}$. A corner 120 on cue 112 defines the outer peripheral end of cue 112, and at a that point, the cue 112 has a diameter $D_{120}$. At the tip end 318, of ferrule 314, an annular securing ring 336 is provided, spaced inwardly from the peripheral surface 316 of ferrule 314. Inward spacing of width $W_{322}$ is provided; in many applications, an inward dimension of width $W_{322}$ of about 1/16 inch is adequate. Likewise, a thickness of annular securing ring 336 is defined by a length $L_{322}$ and in many applications, a length $L_{322}$ of about 1/16 inch is adequate. The annular securing ring 336 has a tip side face 324 sized to fit, in complementary fashion a receiving land 326 in the back 328 of tip 310. Along the centerline $C_L$ of the tip 310, a protruding nipple 330 of diameter $D_{330}$ with flat compression land 332 is provided, transverse to centerline $C_L$.

Behind land 332 of nipple 330, a circular force receiving portion 339 having in interior sidewall 341 is provided in ferrule 255, preferably oriented transverse to the centerline $C_L$ of the cue 112. This force receiving portion 339 is sized complementary to the nipple 330 in the back of tip 310. Also, note that the edge wall 341 defines the edge of the nipple receiving cup 340 of diameter $D_{340}$ which is preferably complementary to diameter $D_{330}$ of nipple 330, so that the nipple 330 is securely and fully received in cup 340.

Radially outer edge 342 of annular securing ring cushion portion 336 defines a diameter $D_{342}$ that is complementary in size to inner edge 334 of the thin annular ring cap 344 in tip 310. The difference between diameter $D_{342}$ and the outer diameter $D_{310}$ of tip 310 defines the width $W_{322}$ of receiving land 326. Length $L_{322}$ defines the thickness of annular securing cushion portion 336; approximately 1/16 inch is adequate length $L_{322}$ in most applications. The configuration just illustrated for the annular securing ring 322 and the nipple receiving cup 340 is important since the cup 340 effectively captures the nipple 332, substantially preventing the tip 310 from spreading after repeated impacts. This construction is often of substantial benefit in preventing the tip 310 from shearing away.

Tip 310 is also provided with an annular edge ring wall 344, having a width of $W_{344}$ and a length $L_{344}$. Thus, the outer periphery of tip 310 is tightly secured to ferrule 314.

Figure 17:
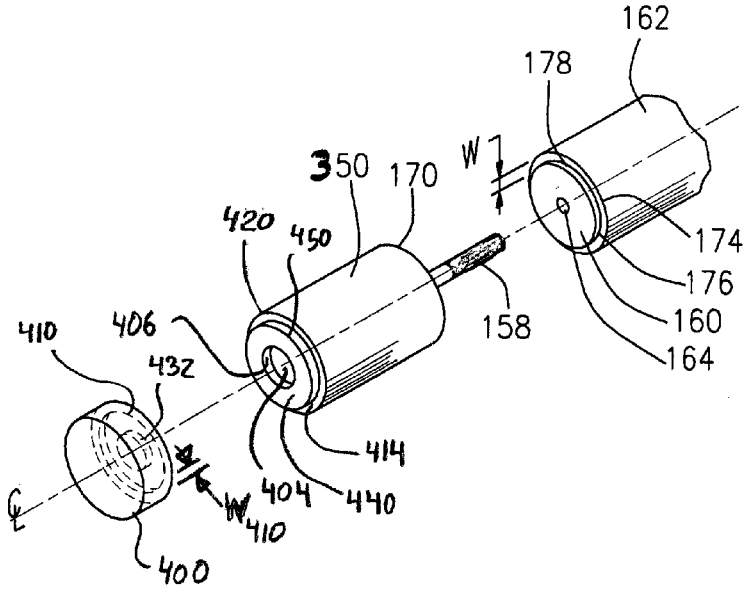
FIG. 17 illustrates still another embodiment of my tip attachment system, where the ferrule permanently mounts to the cue using a cylindrical hardwood mount, and where a large annular area is provided on the cue end of the ferrule for receiving the impact from a cue tip.
Figure 18:
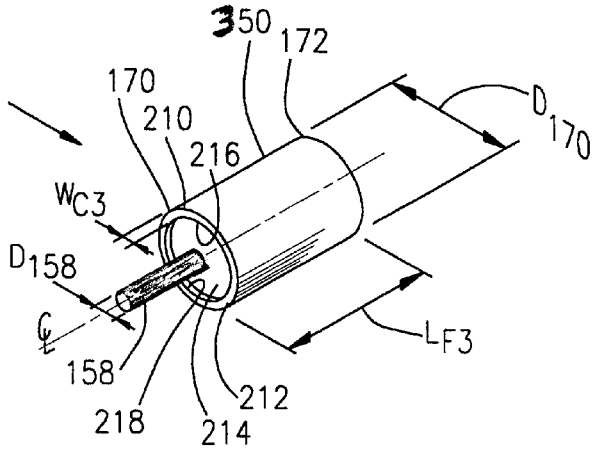
FIG. 18 is a back side perspective view showing details of the design of the permanently mounted ferrule just set forth in FIG. 17, similar to that shown in FIG. 10 above, but now having the contour on the tip end as seen in FIG. 17 above.
Figure 19:
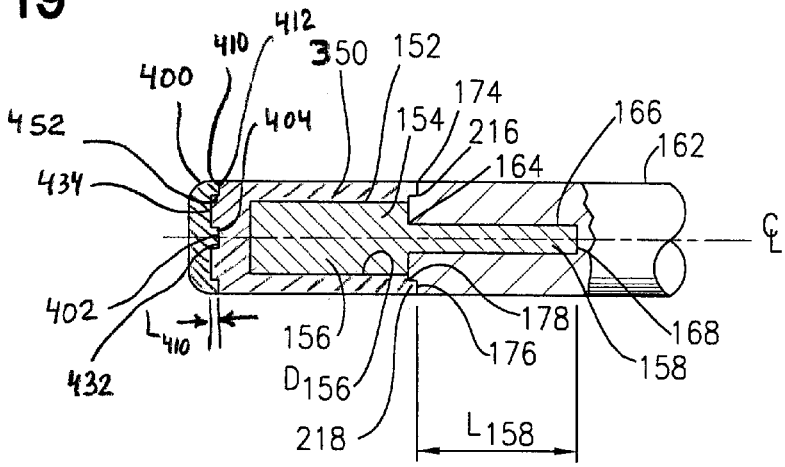
FIG. 19 illustrates the fully assembled components in an embodiment of my tip mounting system, namely the use of a permanently mounted ferrule with a annular securing ring on the tip end for receiving force transmitted from the leather cue tip.

Finally, turning to FIGS. 17, 18, and 19, still another embodiment of my tip mounting system is provided. In this embodiment, my peripheral cap ring system as described above is used in the attachment of a permanent mounting ferrule 350 to a cue 162, similar to the embodiment illustrated in FIG. 9 above. However, the cue tip 400 is provided utilizing my peripheral cap ring system to attach tip 400 to ferrule 350. In this "reverse" approach, the axially located nipple 402 is received in cup 404 defined by sidewalls 406 in the tip end of ferrule 350. A flat land 404 in nipple 402 impacts a flat, impact absorbing cylindrical surface 408 in the tip end of ferrule 150. In this manner, a leather tip 400 is permanently mounted to ferrule 350. This is important, since the advantages of the cap ring system work in both situations to enhance service life of the combination of cue 162, mounting ferrule 350, and tip 400.

The tip 400 is provided with a thin outer peripheral annular cap ring 410 of width $W_{410}$. In many applications, width $W_{410}$ of about 1/16 inch is adequate, and a corresponding depth $L_{410}$ of about 1/16 inch is adequate. The thin peripheral cap ring 410 has a tip side face 412 sized to fit, in complementary fashion, a receiving land 414 in the tip end 420 of mounting ferrule 350. Along the centerline $C_L$ of the tip 400, and transverse thereto, a protruding nipple 402 of diameter $D_{402}$ with flat compression land 432 is provided.

Between the annular cap ring 410 and the nipple 402, an annular shaped, force-transferring portion 434 is provided, preferably flat and oriented transverse to the centerline $C_L$ of the cue 162. This force transferring portion 434 is sized complementary to the annular securing ring 440 provided on ferrule 350. Also, note that the inner edge 406 of annular securing ring 440 defines a nipple receiving cup 404 of diameter $D_{404}$ which is preferably complementary to diameter $D_{402}$ of nipple 402, so that the nipple 402 is securely and fully received in cup 404.

Outer edge 450 of annular securing ring 440 defines a diameter $D_{450}$ that is complementary in size to inner edge 454 of the thin annular cap ring 410 in tip 400. The difference between outer diameter $D_{350}$ and the inner diameter $D_{434}$ of ring 410 defines the width $W_{414}$ of face 414. The configuration just illustrated for the annular peripheral ring cap 410 on tip 400 and the annular securing ring 440 is important since the annular securing ring 440 effectively captures the nipple 402 of the tip 400, substantially preventing the tip 400 from spreading after repeated impacts. This construction is of substantial benefit in preventing the tip 400 from shearing away.

It is to be appreciated that the replaceable cue tip system disclosed herein is a significant improvement in the state of the art of replaceable cue tip systems. My novel replaceable cue tip system is relatively simple, and it substantially improves the reliability of replaceable cue tip systems on billiard and pool cues.

It will thus be seen that the objects set forth above, including those made apparent from the proceeding description, are efficiently attained, and, since certain changes may be made in carrying out the construction of a suitable apparatus to produce the desired joint for attachment of a cue tip to a cue stick, it is to be understood that the invention may be embodied in other specific forms without departing from the spirit or essential characteristics thereof. For example, while I have set forth exemplary designs for improved attachment ferrules, many other embodiments are also feasible to attain the result of the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention to the precise forms disclosed.

The intention is to cover all modifications, equivalents, and alternatives falling within the spirit and scope of the invention as expressed in the appended claims. As such, the claims are intended to cover the structures and methods described therein, and not only the equivalents or structural equivalents thereof, but also equivalent structures or methods. Thus, the scope of the invention, as indicated by the appended claims, is intended to include variations from the embodiments provided which are nevertheless described by the broad meaning and range properly afforded to the language of the claims, or to the equivalents thereof.

I claim:

1. A cue tip attachment system for replaceable attachment of a cue tip to a cue stick, the cue stick having a handle end, a distal end, and longitudinal axis, said system comprising:

(a) an integral, one-piece tip mount, said tip mount having a cue side and a ferrule side, said tip mount further comprising (i) a generally C-shaped central disk portion, said central disk portion comprising (A) an annular shaped axial center edge portion on said cue side, said annular shaped edge portion having a face portion, and (B) an impact-absorbing flat front on said ferrule side;

(ii) a central mounting shaft, said central mounting shaft extending from the center of said tip mount in the cue side direction for a length ($L_{66}$), (iii) a ferrule attachment shaft, said ferrule attachment shaft extending from the center of said tip mount on the ferrule side for a length ($L_{90}$), said ferrule attachment shaft having threads thereon;

(b) a ferrule, said ferrule having a cue end, a tip end, and a length ($L_F$) therebetween with outer surface of substantially circular cross-section, said ferrule further comprising an interior mounting shaft receiving bore having internal threads therein adapted to securely and releasably receive said threads of said ferrule attachment shaft of said tip mount, wherein said flat front of said ferrule side of said integral one-piece tip mount lies flush against said cue end of said ferrule, and wherein said tip end of said ferrule further comprises a central peripheral edge defining a nipple receiving cup portion, said nipple receiving cup portion protruding inwardly from said tip end of said ferrule.

2. The cue tip attachment forth in claim 1, further comprising a cue tip, said cue tip adhesively attached to said ferrule.

3. The cue tip attachment system as set forth in claim 1, further comprising a cue tip, and wherein said cue tip has a ferrule side, and wherein said ferrule side further comprises (A) a centrally located nipple (302) protruding therefrom, sized and shaped for tight fitting engagement with said nipple receiving cup portion of said ferrule, and (B) an annular shaped peripheral edge portion (301).

4. The cue tip attachment system as set forth in claim 3, wherein said cue tip comprises an annular ferrule mount receiving land (312) portion, said ferrule mount receiving land portion extending between said nipple (302) and said peripheral edge portion (310).

* * * * *